United States Patent [19]

Sainsbury

[11] Patent Number: 4,701,073

[45] Date of Patent: Oct. 20, 1987

[54] SHAFT SINKING METHOD

[76] Inventor: Garrett M. Sainsbury, 10 Waratah Avenue, Dalkeith, Western Australia, Australia

[21] Appl. No.: 804,290

[22] Filed: Dec. 3, 1985

[30] Foreign Application Priority Data

Dec. 5, 1984 [AU] Australia ..... PG8420

[51] Int. Cl.[4] ..... E21D 1/00; E21C 37/00

[52] U.S. Cl. ..... 405/133; 299/13

[58] Field of Search ..... 405/132, 133, 138; 175/2; 299/13; 102/312, 313

[56] References Cited

U.S. PATENT DOCUMENTS

| | | | |
|---|---|---|---|
| 115,115 | 5/1871 | Shelley et al. | 299/13 |
| 2,014,163 | 9/1935 | Berlin et al. | 405/133 |
| 3,845,989 | 11/1974 | Ylonen | 405/133 X |
| 4,069,760 | 1/1978 | Eckels | 102/312 X |
| 4,189,185 | 2/1980 | Kammerer | 299/13 |

FOREIGN PATENT DOCUMENTS

| | | | |
|---|---|---|---|
| 902647 | 6/1972 | Canada | 299/13 |
| 3024462 | 1/1982 | Fed. Rep. of Germany | 405/133 |
| 877031 | 11/1981 | U.S.S.R. | 175/2 |
| 898080 | 1/1982 | U.S.S.R. | 175/2 |

*Primary Examiner*—Nancy J. Stodola

*Attorney, Agent, or Firm*—Harness, Dickey & Pierce

[57] ABSTRACT

A method of sinking shafts comprising excavating a series of lifts wherein each lift is excavated by drilling a pattern of blast holes for the full depth of the lift including boring a large diameter hole and creating a chamber at the lower end of the large diameter hole, blasting the walls of the chamber to deposit rock material into the chamber, extracting at least a portion of the rock material created by the blast and repeating the blasting and extraction step throughout the length of the lift wherein on the volume of said lift being blasted the remaining rock broken material is extracted.

16 Claims, 10 Drawing Figures

SHAFT SINKING METHOD

This invention relates to the sinking of shafts in the earths crust. Such shafts may be for the purpose of underground mining operations or any other purposes. In addition such shafts may be vertical or inclined and of varying cross-sections and cross-sectional areas. It is known to provide production shafts in mining operations which can have a cross-sectional area of approximately 35 square meters and depth of 900 meters or greater.

According to conventional procedures the shaft sinking involves the following steps:

(a) boring;
(b) firing;
(c) bogging;
(d) support;
(e) furnishing.

Boring involves the drilling of holes for accommodating explosives in the bottom of the shafts according to a set pattern. In a typical pattern there are 52 38 mm diameter holes in a pattern comprising 6 central pyramid cut holes on a 1.83 meter diameter circle, 10 cut hole easers around a 3.05 meter to 3.5 meter circle, 15 (sometimes 18) crop easer holes on a 4.57 to 5.03 meter circle and 21 cropper holes on a 6.4 meter circle. The holes are usually drilled to a vertical depth of between 1.37 and 1.52 meters.

Firing consist of detonating the individual explosive charges in the above-mentioned pattern of holes in a predetermined sequence in order that a second free face is created initially near the centre of the face of the shaft and subsequently over the whole cross-sectional area of the shaft on firing the subsequent charges in the pattern. It can be expected that a break of 1.22 meters depth will represent 125 tonnes of rock material in a shaft of the form described above using the above hole pattern.

Bogging consists of extracting the broken rock material from the shaft using a bucket and hoist which raises the material to the surface.

The support step involves lining the shaft to prevent rock falls.

The furnishing step comprises partitioning the shaft with horizontal frames at regular intervals to divide the shaft into compartments to accommodate man cages and counter-weights, ore and waste skips, ladder ways and service conduits. The above method of sinking shafts suffers from the principal disadvantage of being very costly. For example recently at the Golden Grove Mining property in Western Australia a 4.6 meter diameter concrete lined shaft was sunk to a depth of 370 meters the total cost of $4 million Australian Dollars.

The above method of sinking shafts has two principle causes for the high cost in shaft sinking with comprise:

(a) the low power of machinery that can be located at the working face;

(b) the cyclic nature of the operation.

In relation to the power of the machines which can be used in a typical shaft, a typical sinking drill which can be used in such an operation applies approximately 6 to 7 kW power to the cutting edges. In open cut mining machines are used which can typically apply power of the order of 90 kW to the cutting edges. The power of the machines available in shaft sinking limits the diameter of the hole which can be drilled (typically to 38 mm) which in turn limits the amount of explosive which can be loaded into the hole resulting in a large number of holes being required to accommodate the amount of explosive necessary to break the rock. It follows that if the holes were of a larger diameter fewer holes would need to be drilled and less expensive lower bulk strength explosives can be used.

The cyclic nature of the shaft sinking operation is unavoidable as there are certain unproductive activities which must be executed in between the phases of the cycle. These activities include:

(a) moving equipment in and out of the shaft after clearing the shaft of rock material and prior to firing the explosives respectively;

(b) waiting for blast fumes to clear from the shaft;

(c) generally cleaning the shaft face of the residual broken material between bogging and boring to avoid the danger created by boring into the face and detonating an unexploded charge from the previous firing.

It is desirable to make each phase of the cycle as long as possible but the controlling factor is the depth of the round that can be fired. In horizontal headings and headings which are inclined upwardly it is possible to achieve advances from 4.75 to 1.2 times the heading diameter per round since the explosive charges are assisted by gravity. In contrast when sinking shafts the explosives are operating against the force of gravity and it seems that approximately 2.5 meters is the maximum depth of round that can be fired even with shafts of large cross-sectional area. In practice the advance per round is limited to about half this depth because of the desire to complete a full bogging, boring and firing cycle in one shift with firing taking place at the end of the shift to give blast fumes time to clear from the shaft before the next shift starts work.

Recently it has been proposed to sink shafts using blind shaft boring machines. These are similar to tunnel boring machines but operate vertically. The machine comprises a large rotating circular cutting head faced with a plurality of conical cutting elements which are faced with tungsten carbide. Each element rotates freely on the head and are arranged over the face of the head to fully cover the entire shaft cross-section. The body of the machine is wedged in the shaft by hydraulic means and other hydraulic rams force the cutting head against the working face as the head is caused to rotate. In some cases the cuttings from the machine are extracted by a suction unit.

Blind shaft boring machines of the above form apply high power to the working face and operate continuously however they are reported to be extremely expensive to operate in hard rock conditions. This is probably because of the high consumption of cutting cones which is the experienced with raise boring machines which operate on the same principle.

It would seem to be contrary to good practice to use expensive boring machines in shaft sinking when cheap efficient explosives are available to effect a similar satisfactory result.

It is an object of this invention to provide a method of shaft sinking with explosives in which the cost of shaft sinking is reduced in relation to the conventional techniques described above.

In one form the invention resides in a method of sinking shafts comprising excavating a series of lifts throughout the length of the shaft wherein each lift is excavated by drilling a pattern of blast holes for the full depth of the lift including boring a large diameter hole, creating a chamber at the lower end of the large diameter hole, blasting the walls of the chamber to deposit rock material into the chamber, extracting at least a portion of the rock material created by the blast and repeating the blasting and extraction step throughout the length of the lift wherein on the full volume of the lift being blasted the remaining broken material is extracted.

According to a preferred feature of the invention sufficient rock material is extracted between each blasting step to provide sufficient space for the rock material created by the subsequent blast.

According to a further preferred feature of the invention said large diameter hole is enlarged throughout its length to provide said chamber.

According to alternative preferred feature of the invention said large diameter hole is enlarged in diameter at its lower end to provide said chamber.

According to an alternative form of the invention of said large diameter hole is enlarged at its lower end to provide said chamber and at spaced intervals along its length to provide spaces to accommodate explosive charges.

According to a preferred feature of the invention said blast holes are charged with explosive charges in the region of the walls of the chamber which have been exposed by the previous blast.

The invention will be more fully understood of the light of the following description of one specific embodiment. The description is made with reference to the accompanying drawings of which:

Figure 7:
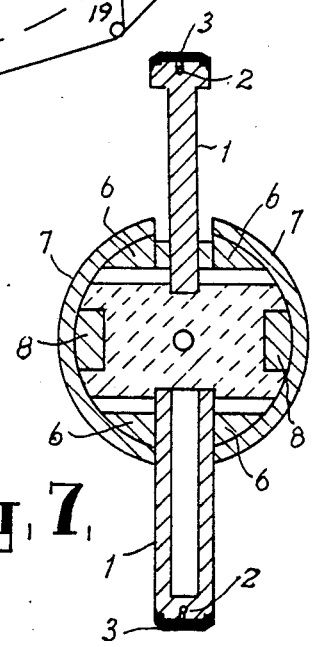
Figure 4:
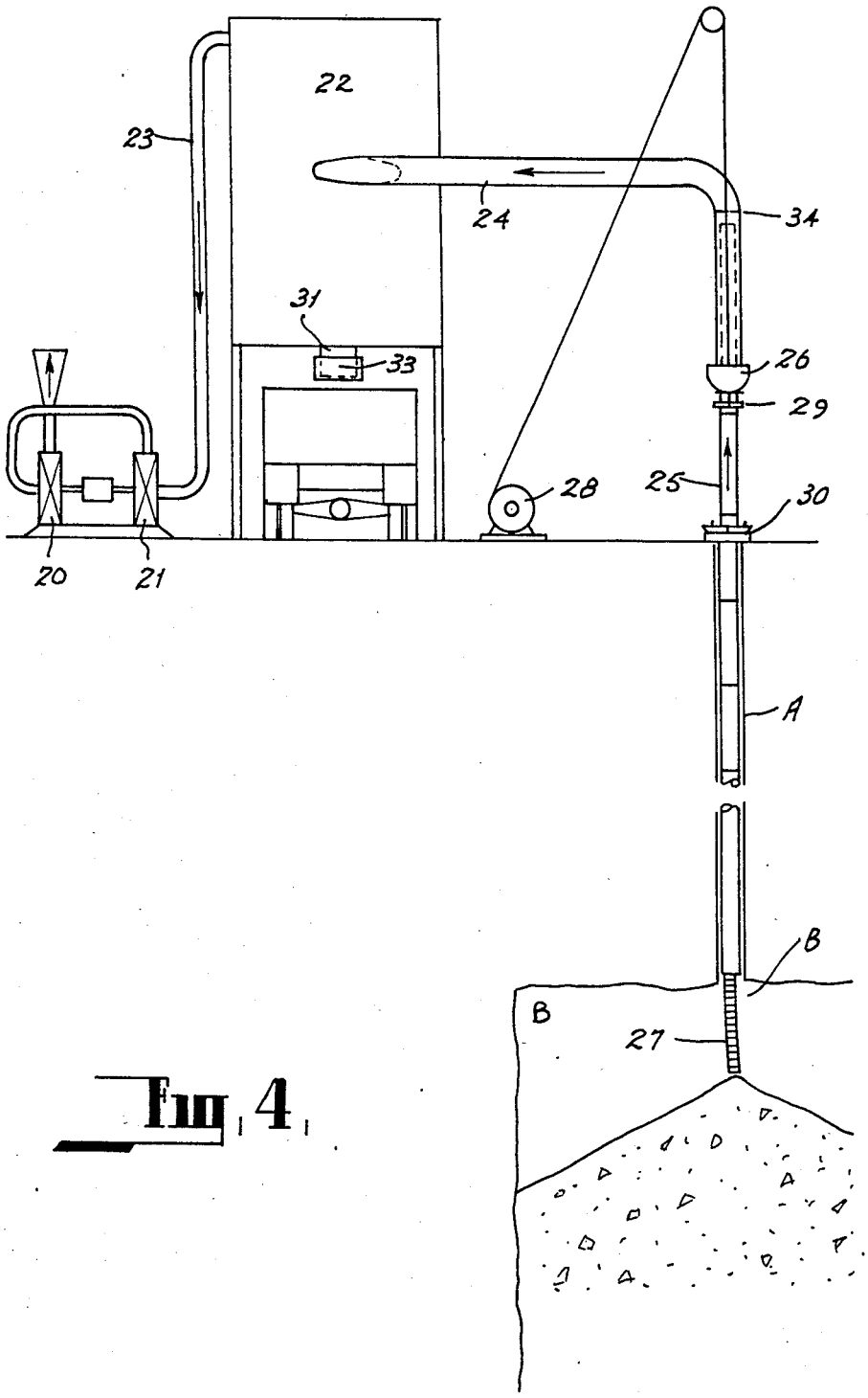
Figure 5:
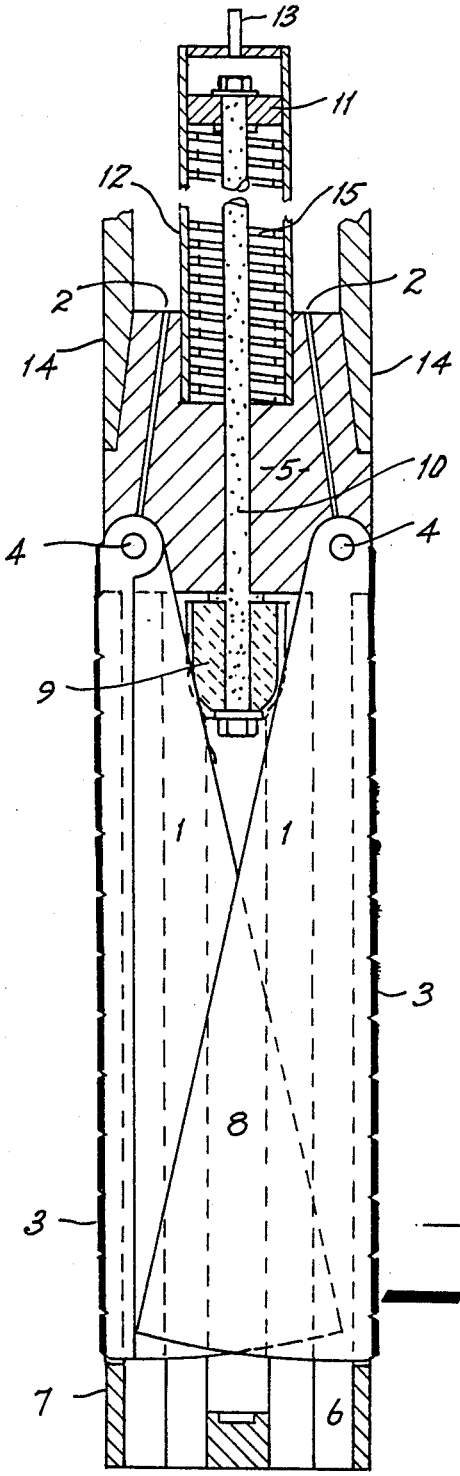
Figure 6:
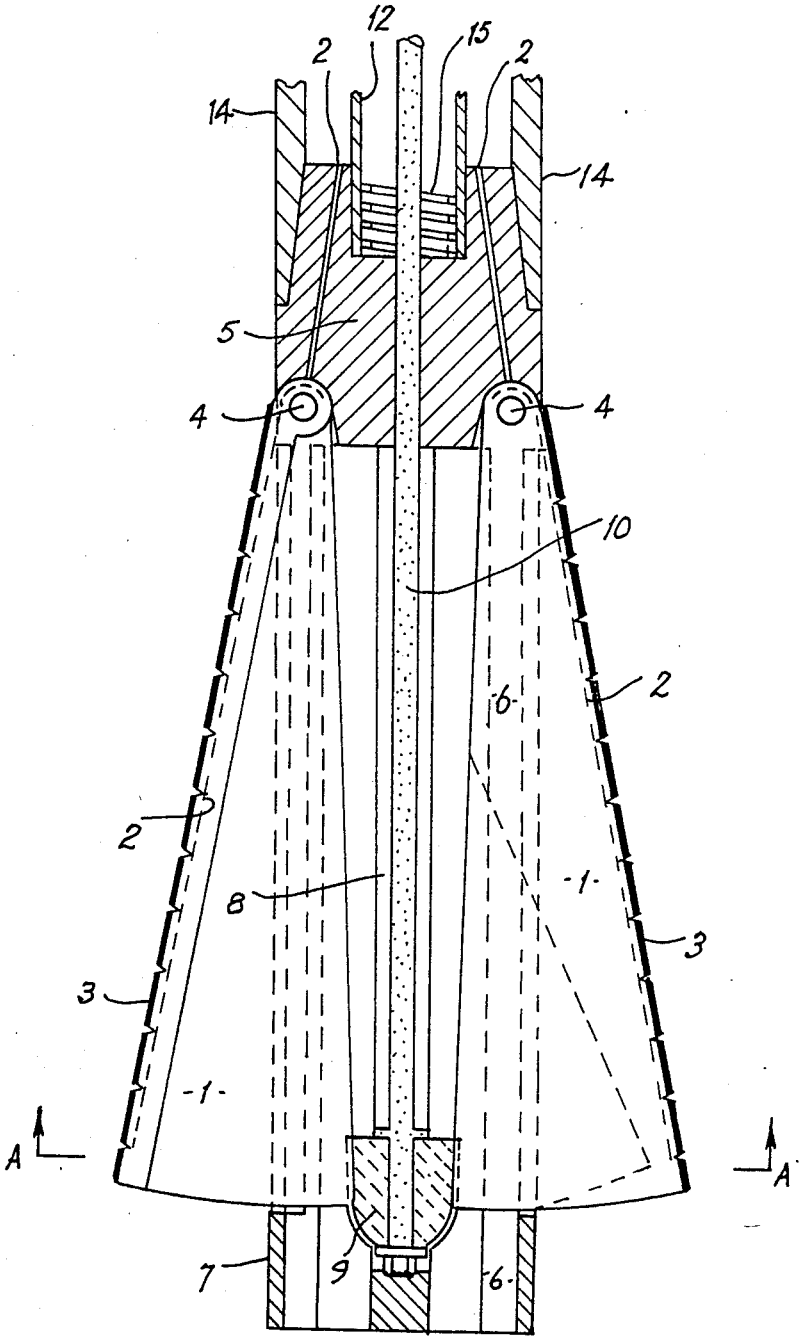

FIGS. 3A, B, C and D are four longitudinal sections of the lower part of the lift at various phases of the embodiment;

FIG. 4 is a schematic representation of a vacuum bogging installation which may be used with the embodiment;

FIG. 5 is a sectional side elevational of a reamer according to the embodiments in the collapsed mode;

FIG. 6 is a sectional side elevation of a reamer according to the embodiment in the expanded mode; and FIG. 7 is a cross-sectional view of a reamer along line A—A of FIG. 6.

Figure 1:
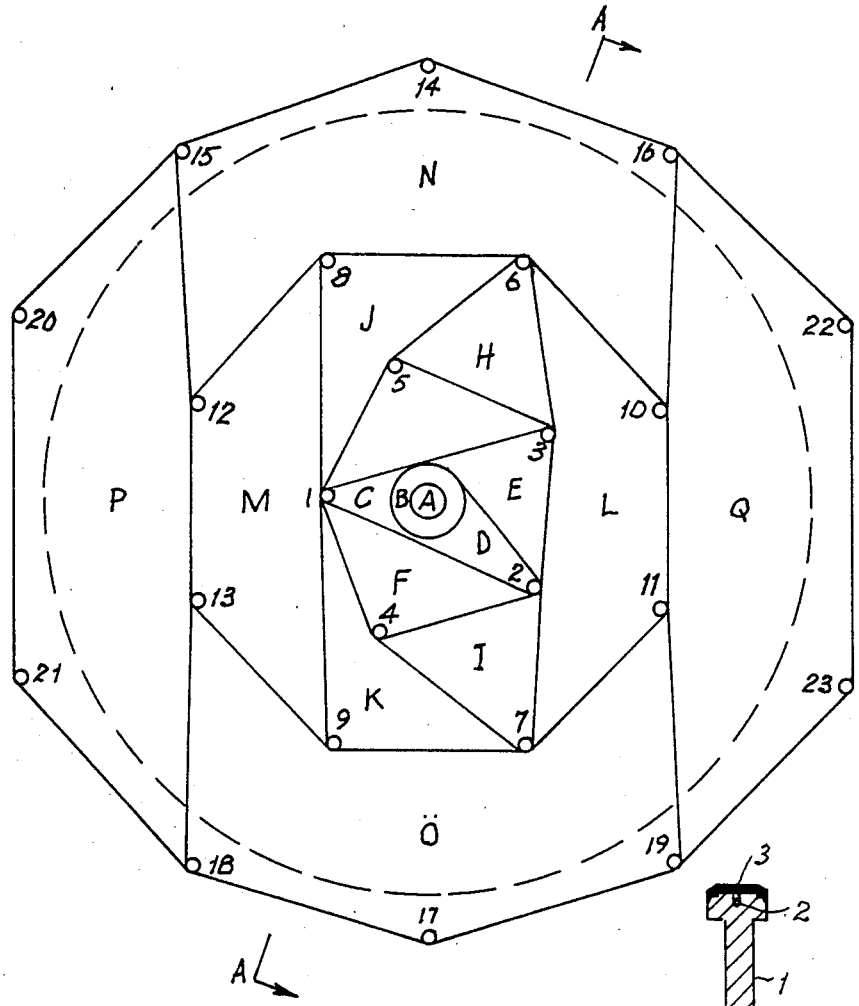
FIG. 1 is a cross-sectional representation of a shaft showing the pattern of drill holes used for a lift according to the embodiment.

The embodiment is directed to the sinking of a shaft in a series of lifts. At the commencement of each lift all of the required blast holes 1 to 23 (see FIG. 1) which are required are drilled to the full length of the lift according to a somewhat conventional pattern. In addition a central large diameter hole A is driven for the full length of the lift. The large diameter hole is then reamed out to define an enlarged chamber B at the lower end of the hole at least, using a reamer of the form shown at FIGS. 5 to 7 described below. If desired the hole A may reamed out for its whole length using the reamer of FIGS. 5 to 7 or a conventional hole opener as is commonly used in oil well drilling.

Suitable diameters for the central large diameter hole may be of the order of 254 to 311 mms and the blast holes may have diameters in the region of 121 mms. The blast hole pattern is controlled by well known criteria which include:

(a) explosive weight to broken rock volume ratios;

(b) explosives strength;

(c) rock swell factor (rock when crushed and well broken by explosives expands by a factor of 35 percent);

(d) the distance of easer holes from the central large diameter hole;

(e) the ratio of burden on a hole to the length of the free face it is breaking to. (This ratio should be in the range of 0.5 to 0.87—except for the initial cut easers);

(f) if two holes are blasting to a free face the load should be equally distributed between them and the ratio of burden to the hole spacing should not be less than 0.5. (Blasting of two such holes simultaneously will break the wedge of rock between them which would otherwise remain unbroken if the holes were blasted separately.)

On drilling of the blast holes and the central large diameter hole the lower end of all of the drill holes 1 to 23 surrounding the chamber B are charged with explosive. The explosives are fired sequentially whereby the broken rock material produced by each firing fills the chamber B. Between each firing at least a portion of the broken rock material so produced is removed by vacuum bogging to provide sufficient space for the rock material produced by the subsequent firing.

The height to which each hole is charged with explosives to form the initial chamber depends upon the expected height of subsequent rounds, the proportion of oversized fragments produced, the depth of butts (i.e. holes left in the floor because rock will not break to the full depth of the charged hole) and the type of blasting action applied. The rounds fired after the initial chamber round can be fired either as big hole burn cuts or as modified pyramid cuts. In the first case the holes are first plugged at the bottom (i.e. where they emerge from the free face) by a suitable means. An example of such means comprise using short lengths of closed pipe made of a suitable malleable metal and containing a small charge of lower power explosives. These would be lowered to the bottom of the hole where the charge would be detonated wedging the pipe against the walls of the hole. The holes are then loaded with explosives to the required height above the free face and sealed with a plug of a suitable impervious compound. The holes are then filled with water which acts as an efficient stemming to confine the explosives. In the cut holes and easer holes 1 to 5 or 9, the explosives should be distributed along the full length of the appropriate section of the hole rather than tamped into the top half as is sometimes the practice. In some rock conditions this can result in failure through the collar of the rock failing to break. In order to maintain a reasonable explosives ratio, the holes are not completely filled with explosives, rather the charges are broken up into segments by the use of wooden spacer blocks. The holes are fired in the sequence indicated in FIG. 1 using suitable time delay electric detonators.

Figure 2:
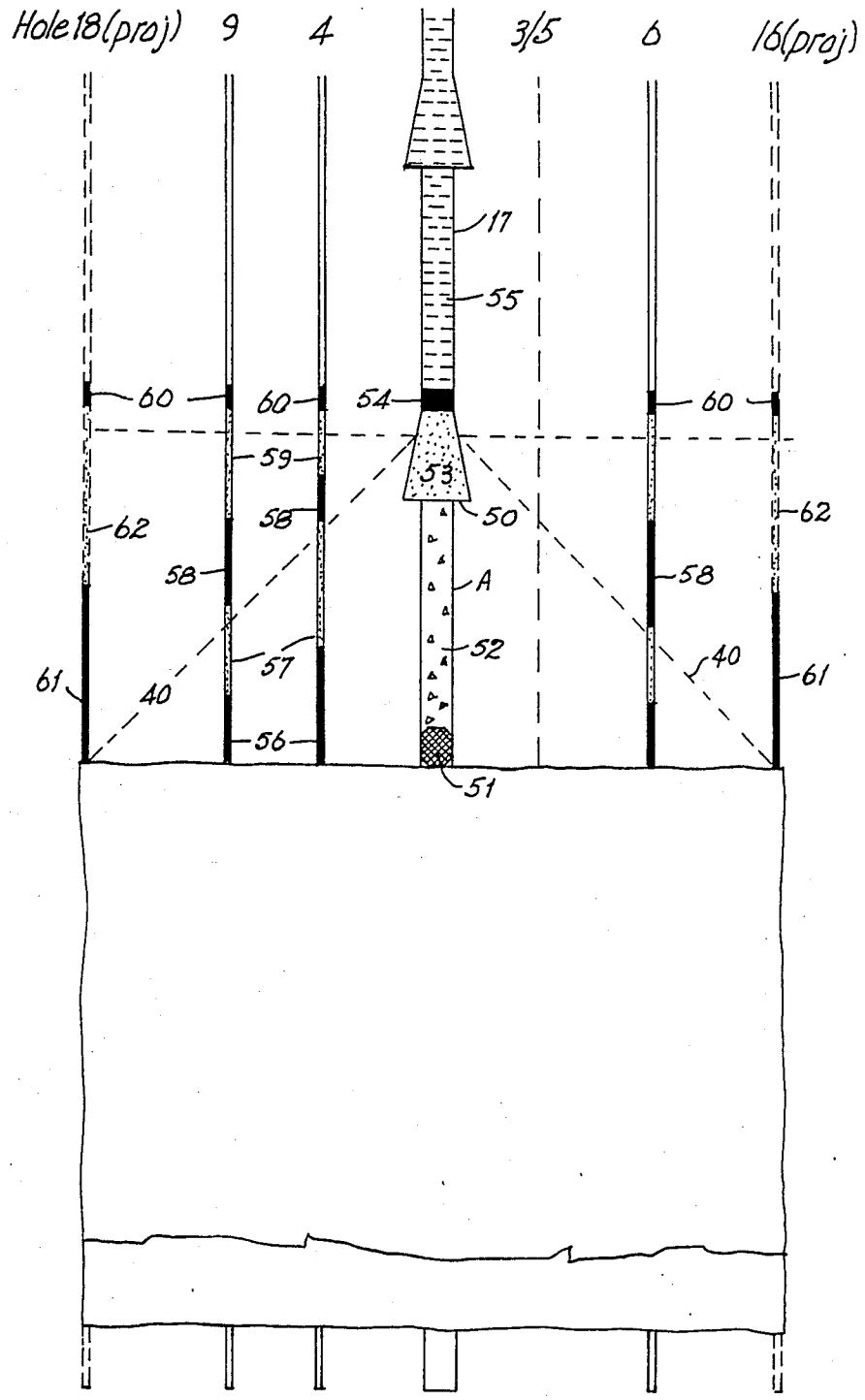
FIG. 2 is a longitudinal section along line A—A of FIG. 1 of the lower portion of a lift according to the embodiment showing a blasting arrangement for a lift.

The disadvantage of the above system is that the central large diameter hole A must be reamed out to full size throughout its entire length. This is not necessary if a modified pyramid cut is used. Referring to FIG. 2, the line 40 therein is taken as an imaginary conical surface the base diameter of which corresponds to the minimum diameter of the shaft and the apex of which is located at the centre of the shaft. A chamber 50 is reamed in the central large diameter hole at the apex of the cone 40 using the hole reamer described below. Similar chambers are located at regular intervals up the length of the central large diameter hole A. The interval corresponding to the height of the rounds. The bottom of the central hole is blocked by suitable means 51 and filled with a quick setting cement grout 52. The chamber is filled with explosives 53 and sealed with a plug of suitable impervious compound 54. The hole is then filled with water 55 which acts as stemming to confine the charge. Surrounding holes are similarly plugged at the bottom and filled with a quick setting grout 56 to a point half way between the face the surface of the cone. They are filled with explosives 57 to slightly above the surface of the cone. An impervious plug is placed on top of the explosives and more grout 58 is placed extending from the imprevious plug to a point half way to a horizontal plane extending through the apex of the cone. More explosives 59 are then placed extending to above the horizontal plane and impervious plugs 60 are placed above the explosives 59. The drill holes are then filled with water as described above. The peripheral holes 14 to 23 inclusive are partially filled with grout 61 topped with explosives 62 to the same height as the other holes, plugged and filled with water stemming. The charge in the reamed chamber and the charges in the bottom part of the surrounding holes are detonated simultaneously using instantaneous electric detonators. The charges in the top part of the hole surrounding the central hole and the peripheral holes are detonated in the sequence indicated in FIG. 1 using suitable time delay electric detonators.

FIG. 4 illustrates a suitable vacuum of bogging installation for extracting rock material from the first and subsequent lifts. The installation comprises a pair of extractor fans 20 and 21 which exhaust a cylindrical hopper 22 through a duct 23. The inlet hopper 22 is connected to an inlet duct 24 which terminates at a vertical leg which telescopically receives a delivery duct 25. The delivery duct 25 passes through the central large diameter hole A and terminates at the chamber B. A seal 26 is provided between the ducts 24 and 25. The lower end of the delivery duct 25 supports the flexible tube 27 which is located in the chamber B and picks up rock material in the chamber B for it to be carried to the hopper 22. The delivery duct can be raised or lowered by means of a winch 28 which is connected to a collar clamp 29 on the exterior of the delivery duct 25. A further support collar 30 is countered to the exterior of the delivery duct 25 to support the delivery duct 25 on the opening of the large diameter hole A. when the position of the collar clamp 29 is being varied on the delivery duct. The hopper 22 has a discharge chute 31 at its lower face to facilitate the discharge of the contents of the hopper into a truck or like means. A gate 33 is used to close and seal the chute 31 during bogging procedures. In operation the delivery duct 25 is lowered into the central large diameter hole A until the end of the flexible tube contacts the broken rock material in the chamber B. Air enters into the chamber B through the space between the delivery duct 25 and wall of the central large diameter hole A and enters the flexible tube entraining rock fragments from the chamber B as it does so to carry them to the hopper 22. The end of the flexible tube 27 is maintained in contact with the broken rock material until the required volume of material has been removed to provide sufficient room for the next blast. Large slabs of rock may be broken or forced out of the way by means of a heavy cable rig type cutting tool introduced into the duct 25 after being disconnected from the inlet duct 24. If desired suitable means may be provided on the flexible duct to facilitate control of its position in the chamber B from the surface. In addition if desired a camera may be lowered into the chamber B to monitor progress of the bogging operation.

The above-mentioned bogging operation will not work if the end of the flexible tube is underwater. Therefor the level of water in the chamber B should be kept low by the use of a suitable bore hole pump. If the water flow into the chamber is excessive then water can replace air as the air transport medium. This would involve sealing all drill holes and the central large diameter hole and pumping water down several of the holes. The water would return to the surface through the delivery duct 25 to be drained from the rock material and to be returned to the drill holes. Alternatively if a heavy water flow is anticipated the water bearing aquifiers and/or fissures can be sealed before drilling the lift by injecting cement grout under pressure through the bore holes according to established procedures.

Figure 3:
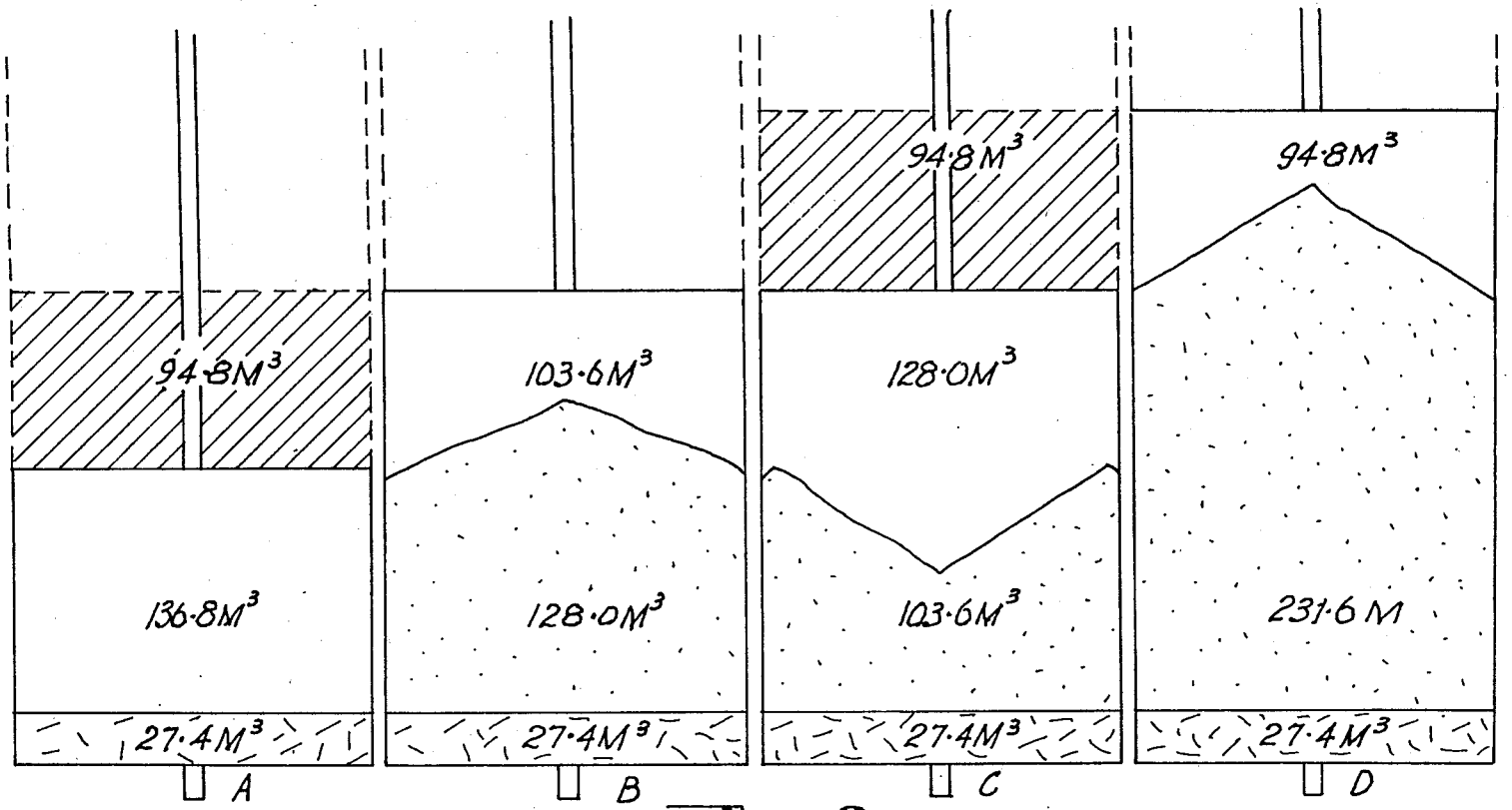

FIG. 3 shows a sequence of blasting a lift and clearing the chamber. The position before firing the first pyramid cut is shown at FIG. 3A and position after firing the first pyramid cut is shown at FIG. 3B. In the representative example shown in relation to the drawing, because 0.2 meters of butts are left the advance is 2.9 meters, breaking $(32.7\times2.9)$ 94.8 cubic meters which expands to $(94.8\times1.35)$ 128 cubic meters. This leaves $(94.8+(136.8-128pl))$ 103.6 cubic meters of free space which must be increased to 128 cubic meters by vacuum bogging 24.4 cubic meters of broken rock which represents (24.4/128) 19% of the weight of material broken by the first round. The position after vacuum bogging is shown in FIG. 3C.

The position after firing the second round is shown in FIG. 3D.

The free space is 94.8 cubic meters which must be increased to 128 cubic meters by vacuum bogging 33.2 cubic meters which represents $(33.2\div128)$ 26% of the rock broken by the second round. This procedure is followed for the remainder of the lift, that is, after each 2.9 meter high round is fired 26% of broken material is removed. Finally when the last round of the lift is fired as a big hole burn cut, the residual broken rock which fills the lift from top to bottom is removed on a continuous basis by any suitable means such as a cactus grab.

When all of the rock material has been extracted from the lift the walls of the shaft are inspected and loose rock is removed. Rock bolts and mesh are installed in the walls of the shaft and any residual broken rock is removed from the shaft by hand bogging. When all broken rock is removed from the shaft suitable formwork is then lowered and installed in the shaft and the space between them and the walls of the shaft is filled with concrete as one continuous monolith which may be formed at the top to form the floor of the plat thereon and the section of the shaft below the formwork is then stripped to form the next plat and the drilling equipment is moved down to this level for the next lift.

In enlarging the diameter of the central large diameter hole A a reamer may be used as discussed. The reamer may take the form of that shown at FIGS. 5, 6 and 7. The reamer comprises substantially a cylindrical body 5 which is threaded at one end for engagement with the lower end of a drill string 14. The other end of the body 5 is formed with four axially extending prongs 6 which are received in a slotted tube 7. The interior of the tube 7 supports a pair of diametrically opposed guides 8. The body 5 pivotally supports a pair of wings 1 which are received in the slots of the tube 7 and pivotally mounted to the body to pivot about a chord axis of the body 5 and are pivotable between a position at which their exterior cutting surface 3 is substantially co-linear with the exterior surface of the slotted tube 7 and body 5 and an outer position as shown at FIG. 6 at which the exterior cutting surface 3 is inclined outwardly from the body 5. The exterior surface 3 of the wings support tungsten carbide or diamond or like abrasive elements. The interior face of the wings 1 are formed such that they are complimentary with each other and when wings are at their innermost position in the tube as shown at FIG. 5 the inner edges of the wings matingly engage each other. The inner edges of the wings 1 are associated with a wedge member 9 which is slidably supported within the slotted tube 7 on the guides 8 between the wings whereby with axial movement of the wedge 9 away from the cylindrical body 5 the wedge engages the innermost edge of the wings 1 to force the wings to their outermost position. The movement of the wedge 9 is effected through a push rod 10 driven from a hydraulic cylinder 12 whereby the push rod 10 is fixed at its end to the piston 11 of the hydraulic cylinder 12 and fluid is introduced into the hydraulic cylinder through the hydraulic line 13 which is supported in the drill string 14. The piston 11 is biassed to its retracted position within the hydraulic cylinder 12 by a spring 15.

Drilling fluid is supplied to the exterior cutting surface of the wings 1 through passages 2 in the cylindrical body 5 whereby the passages extend from the interior of the drill string to the exterior outting surface 3.

In operation the reamer is attached to the end of the drill string in its closed position and lowered to the point in the hole where reaming is to commence. The rotary drive on the drill is engaged giving the reamer a suitable rotation speed and the reamer hydraulic cylinder 12 is then pressurised so that the wedge 9 starts to force the wings 1 apart bringing the cutting surfaces 3 into contact with the walls of the hole at a suitable pressure. This is continued until the wings are fully extended as shown at FIG. 7. The pullback mechanism on the drill is then activated so that the combination of suitable revolution speed and suitable pressure on the cutting surface reams out the hole over the required length. To pull the reamer out of the hole the pressure in the hydraulic cylinder 12 is released and the spring 15 causes the wedge 9 to be retracted to its position adjacent the cylindrical block 5. The rock surface will then force the wings 1 back to their closed position as the drill string pulling continues to extract the reamer from the hole.

It should be appreciated that the scope of the present invention need not be limited to the particular scope of the embodiment described above.

I claim:

1. A method of sinking shafts comprising excavating a series of lifts wherein each lift is excavated by drilling a pattern of blast holes for the full depth of the lift boring a large diameter hole for the full depth of the lift, creating a chamber only at the lower end of the large diameter hole, blasting a portion of the walls of the chamber to deposit rock material into the chamber, extracting at least a portion of the rock material created by the blast and repeating the blasting and extraction step throughout the length of the lift from the bottom to the top and when the volume of said lift is blasted extracting the remaining rock broken material.

2. A method of sinking a shaft as claimed in claim 1 wherein sufficient rock material is extracted between each blasting step to provide sufficient space for the rock material created by the subsequent blast.

3. A method of sinking shafts as claimed in claim 2 wherein said large diameter hole is enlarged throughout its length to provide said chamber.

4. A method of sinking shafts as claimed in claim 2 wherein said large diameter hole is enlarged in diameter at its lower end to provide said chamber.

5. A method of sinking shafts as claimed in claim 2 wherein the large diameter hole is enlarged at its lower end to provide said chamber and at spaced intervals to provide spaces to accommodate explosive charges.

6. A method of sinking shafts as claimed at claim 5 wherein said intervals correspond to the location of each round of explosive for each blast.

7. A method of sinking shaft holes as claimed in claim 2 wherein said blast holes are charged with explosives in the region of the walls of the chamber exposed by the previous blast.

8. A method of sinking shafts as claimed in claim 1 wherein said large diameter hole is enlarged throughout its length to provide said chamber.

9. A method of sinking shaft holes as claimed in claim 8 wherein said blast holes are charged with explosives in the region of the walls of the chamber exposed by the previous blast.

10. A method of sinking shafts as claimed in claim 1 wherein said large diameter hole is enlarged in diameter at its lower end to provide said chamber.

11. A method of sinking shaft holes as claimed in claim 10 wherein said blast holes are charged with explosives in the region of the walls of the chamber exposed by the previous blast.

12. A method of sinking shafts as claimed in claim 1 wherein the large diameter hole is enlarged at its lower end to provide said chamber and at spaced intervals to provide spaces to accommodate explosive charges.

13. A method of sinking shaft holes as claimed in claim 12 wherein said blast holes are charged with explosives in the region of the walls of the chamber exposed by the previous blast.

14. A method of sinking shafts as claimed in claim 12 wherein said intervals correspond to the location of each round of explosive for each blast.

15. A method of sinking shaft holes as claimed in claim 14 wherein said blast holes are charged with explosives in the region of the walls of the chamber exposed by the previous blast.

16. A method of sinking shaft holes as claimed in claim 1 wherein said blast holes are charged with explosives in the region of the walls of the chamber exposed by the previous blast.

* * * * *